United States Patent [19]

Baldwin

[11] 4,095,690

[45] Jun. 20, 1978

[54] PYRAMID RECORD COVER AND RACK

[76] Inventor: Cliff Baldwin, c/o George Spector, 3615 Woolworth Building, 233 Broadway, New York, N.Y. 10007

[21] Appl. No.: 665,239

[22] Filed: Mar. 9, 1976

[51] Int. Cl.[2] ..... B65D 85/30

[52] U.S. Cl. ..... 206/312; 229/22; 206/223

[58] Field of Search ..... 229/22, 8; 206/309–313, 223; 211/40, 41

[56] References Cited

U.S. PATENT DOCUMENTS

| | | | |
|---|---|---|---|
| D. 132,201 | 4/1942 | Slough | 211/41 |
| 3,885,266 | 5/1975 | Nafziger | 229/22 |

FOREIGN PATENT DOCUMENTS

| | | | |
|---|---|---|---|
| 758,968 | 1/1934 | France | 229/22 |

*Primary Examiner*—William Price
*Assistant Examiner*—Douglas B. Farrow
*Attorney, Agent, or Firm*—Fetherstonhaugh & Co.

[57] ABSTRACT

A playing record cover which when in the open position assumes a pyramid shape for combined use as a turntable dust cover and storage rack for records.

3 Claims, 5 Drawing Figures

PYRAMID RECORD COVER AND RACK

This invention relates to a cover for records which can be opened and disposed in a pyramid shape for use as an attractive decorative dust cover mounted over a turntable and adapted to function simultaneously as a record rack.

Previous record covers merely functioned to store records a a flat package whereby the cover had no further usage. The instant invention provides an attractive construction whereby the cover can be assembled to form an attractive cover for a turntable and can also be used as a record rack thereby increasing the utility of the cover. The preferred form of the pyramid has four sloping sides collapsible to form the upper portion of the cover, whereby the dimensions of the pyramid are in exact proportion to that of the ancient Great Pyramid located in Egypt.

Accordingly, the primary object of this invention is to provide a record cover which provides a flat package in the closed position and which assumes the form of a pyramid in the open position for use as a combined turntable cover and storage rack for records.

A further object is the provision of a pyramid shaped turntable cover and record rack.

Other objects are to provide a Pyramid Record Cover and Rack which is simple in design, inexpensive to manufacture, rugged in construction, easy to use and efficient in operation.

These and other objects will be readily evident upon a study of the following specifications and the accompanying drawing wherein:

GENERAL DESCRIPTION

Figure 1:
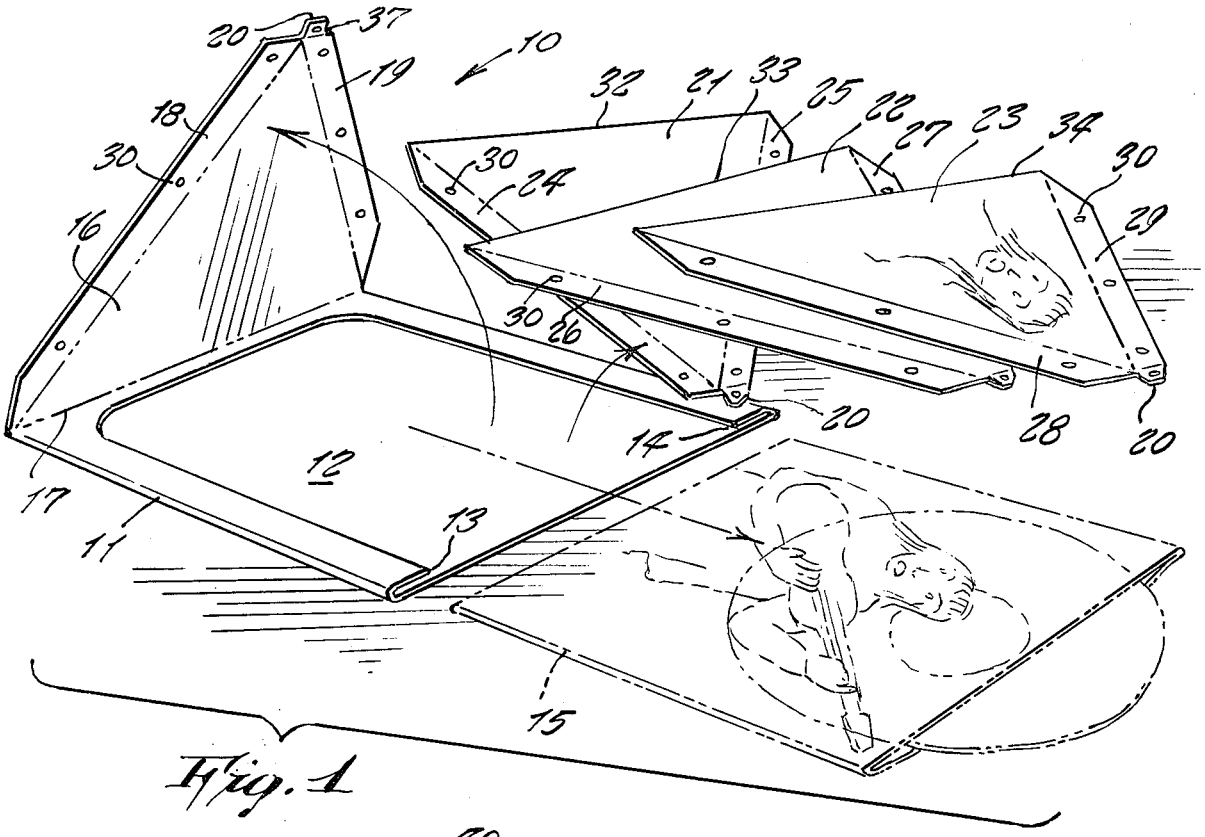
FIG. 1 is a perspective view of the invention disassembled.
Figure 2:
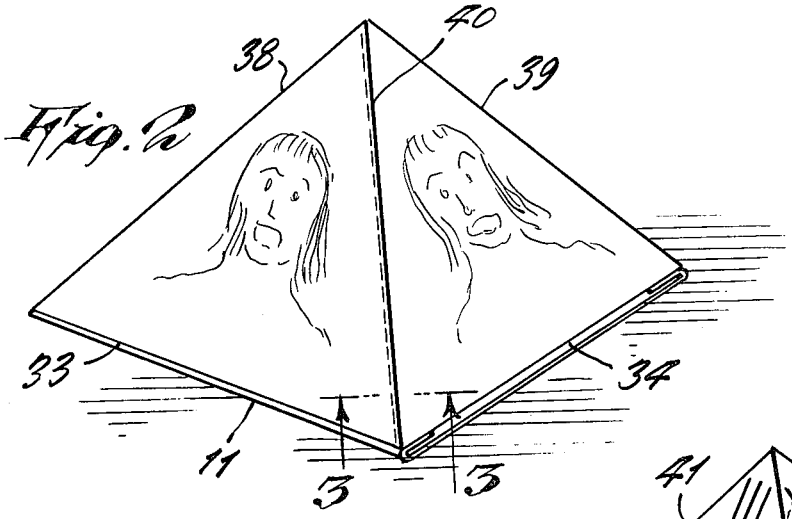
FIG. 2 is a perspective view of the invention assembled in pyramid shape.
Figure 3:
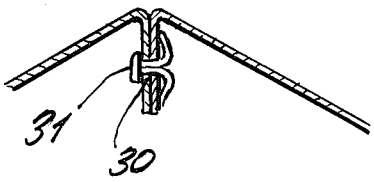
FIG. 3 is a cross section through line 3—3 of FIG. 2.
Figure 4:
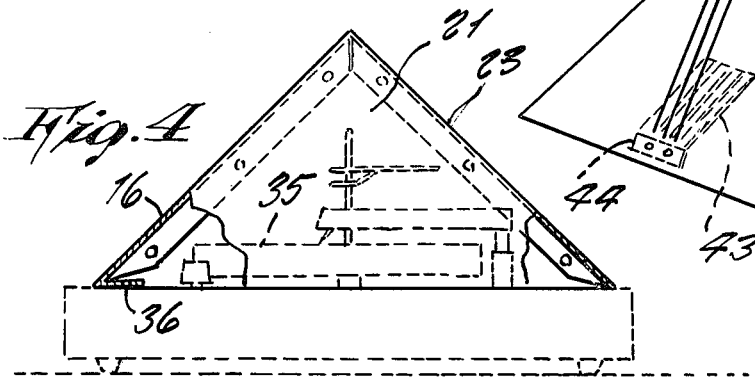
FIG. 4 is an elevation of the assembled form partly in cross-section.

Referring to FIG. 1, the cover 10 is seen to comprise a base 11 having a bottom 12 with slots 13 and 14 adapted to receive a record jacket 15 therein for storage purposes. A triangular side 16 is pivoted or hinged at 17 to an edge of the base 11 and includes diagonal flaps 18 and 19 along the diagonals meeting at an apex tab 20. It should be understood that the side 16 may be integrally hinged to base 11 or may be separable and secured by means of conventional holes and fasteners as seen in connection with the diagonal flaps 18 and 19. Triangular sides 21, 22 and 23 are provided with similar diagonal flaps 24, 25, 26, 27, 28 and 29 which include holes 30 along the flaps whereby the diagonal flaps may be joined to form the pyramid by means of fasteners 31 (See FIG. 3). When assembled to form the pyramid (FIG. 2) the edges 32, 33 and 34 form a bottom periphery which may be supported about the base 11 or a turntable 35 as seen in FIG. 4. Please note that the side 16 in FIG. 4 includes a flap 36 which as stated hereinabove is separable from base 11. The apex of the pyramid is further secured by means of the apex tabs 20 which have holes 37 to receive a fastener. Alternately the diagonal corner seams 38 and 39 where the triangular sides are jointed may be integrally hinged by means of flexible material (FIG. 2) excepting for one separable seam 40 which is secured by the fastener hole construction 30, 31 of FIG. 3, whereby the pyramid may be formed by merely raising the three triangular sides from the collapsed flat position and then securing the open seam 40 with fasteners.

Thus, it is apparent that the assembled four sided pyramid cover may be separated from the base 11 and placed over a turntable 35 or other object to form an attractive dust protector. The sides may have attractive posters, paintings, etc., mounted thereon for decorative purposes.

Figure 5:
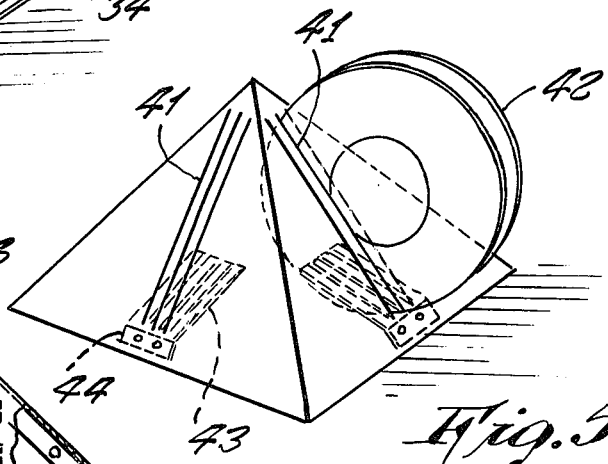
FIG. 5 is a perspective view of the assembled form adapted for use as a record rack.

In FIG. 5, the cover is seen to further include parallel slots 41 in the sides to receive records 42 for use as a rack. A coacting slotted member 43 may be pivotably mounted at 44 to provide a bottom support for the records. When the cover is collapsed the member 43 collapses against the inner face of the sides.

It is thus apparent that hereinabove described cover package can be conveniently used to store records flat, to provide a dust cover and record rack when assembled in pyramid form.

It is to be understood that this invention includes the use of all appropriate materials such as transparent plexiglass, cardboard, wood, etc., and can be in various dimensions and pyramid forming shapes.

While various changes may be made in the detail construction, it is understood that such changes will be within the spirit and scope of the present invention as is defined by the appended claims.

What is claimed is:

1. A record package comprising a base with means to receive a record therein in flat position in combination with a plurality of triangular sides and means for removably securing the sides to said base and to each other whereby the sides may be folded to a flat closed position adjacent to the base forming a flat cover therefor and whereby the sides may be opened and erected to form a pyramid superstructure above said base, wherein the first said means comprises a slot about the periphery of the base having spaced openings at opposite sides of said base to receive a record.

2. A package as in claim 1 whereby the sides are removable from the base to provide a pyramidical cover for a turntable, having spaced slits in said sides to receive and support records therein.

3. A package as in claim 1 wherein each side includes pivotable flaps along two edges whereby each flap is adapted to abut an adjacent flap from an adjacent side when erecting a pyramid superstructure, said flaps being perforated to receive fasteners, wherein one of said sides includes a tab at one corner to secure the cover in pyramid form at its apex.

* * * * *